US005429672A

United States Patent [19]

DeNuccio

[11] Patent Number: 5,429,672

[45] Date of Patent: Jul. 4, 1995

[54] SILICA EFFECT CONTROL DURING METAL DEPOSITION

[75] Inventor: Ronald J. DeNuccio, Greensboro, N.C.

[73] Assignee: Hilemn Laboratories, Inc., Greensboro, N.C.

[21] Appl. No.: 275,266

[22] Filed: Jul. 15, 1994

[51] Int. Cl.[6] ..... C23C 16/00; C23C 18/00

[52] U.S. Cl. ..... 106/105; 106/1.11; 106/1.23

[58] Field of Search ..... 106/1.05, 1.11, 1.23

[56] References Cited

U.S. PATENT DOCUMENTS

| | | | |
|---|---|---|---|
| 4,956,014 | 9/1990 | Kondo et al. | 106/1.23 |
| 5,039,338 | 8/1991 | Kondo et al. | 106/1.23 |
| 5,306,336 | 4/1994 | Martyak et al. | 106/1.23 |
| 5,318,621 | 6/1994 | Krulik et al. | 106/1.23 |

*Primary Examiner*—Helene Klemanski

[57] ABSTRACT

The harmful effects exhibited by excess silica ($Si_2O$) in electroless metal deposition solutions can be controlled by the use of certain amines. The amines can be prepared in separate solutions or can be incorporated into usual plating solutions to effectively control the effects of excess silica present. The amines can be shown to prevent voiding on glass substrates during silver deposition which often occurs with excess silica of amounts over 0.5 ppm.

26 Claims, No Drawings

SILICA EFFECT CONTROL DURING METAL DEPOSITION

BACKGROUND OF THE INVENTION

1. Field Of The Invention

The invention herein pertains to controlling the deletrious effects of silica during metal deposition and particularly pertains to controlling silica effects during the electroless deposition of silver on glass substrates.

2. Background And Objectives Of The Invention

Silica ($SiO_2$) occurs naturally and is the most common of all chemicals compounds. Silica is contained in most water as it is derived from dissolved silicate materials. Silica is extremely detrimental to metal deposition or plating processes at 0.5 parts per million (ppm) or more and in the mirror industry, the effects of excess silica can be seen as a reduction in plating efficiency (the amount of silver deposited per square foot of glass) to a partial or even a complete inhibition of the plating process. In extreme cases, plating is disrupted to the point that no metal is deposited and as a consequence, mirror manufacturers generally install complex and expensive water purification systems to remove silica and other impurities which may be present in the water supply. Such purification systems usually employ ion exchange resins including mixed cation and anion resins and activated carbon. However, when these exchange resins approach their capacity, silica will begin to be released in small and then larger amounts (ppm). The amounts of silica released after exchange resin saturation can be in far greater concentrations than in the untreated water and as such, can cause havoc to the plating process. As a result, many plating operations have implemented monitoring procedures to determine increases in silica amounts. However, such monitoring does not quickly respond and the plating reaction deteriorates rapidly before defensive actions can be taken, causing the mirror substrates to have large unplated areas or voids. Once these voids have been detected by visual inspection the plating lines must be shut down and the ion exchange resins regenerated or replaced in order to continue production. Oftentimes many hundreds or even thousands of dollars can be wasted by failure to quickly determine the silica increases. As the mirror plating industry is very cost conscious and price competitive even a very short production of poor quality plating will waste expensive plating solutions, glass and workers' time. Regeneration of the water purification systems will likewise cause additional expense if conducted more than necessary to minimize the capture of excess silica (herein defined as amounts over 0.5 ppm).

Thus, with the problems and disadvantages of conventional metal plating processes in handling excess silica concentrations, it is an objective of the present invention to provide a means to control the available silica and its adverse effects in metal plating solutions.

It is also an objective of the present invention to provide a number of chemical compounds which can be added to conventional plating solutions to combat and control the effects of excess silica.

It is also an objective of the present invention to provide an amine compound which will control the harmful effects of silica in plating solutions.

It is still another objective of the present invention to provide a metal plating solution that will perform well with high concentration of silica present.

Various other objectives and advantages of the present invention will become apparent to those skilled in the art as a more detailed description is set forth below.

SUMMARY OF THE INVENTION

The aforesaid and other objectives are realized by controlling excess silica amounts in metal deposition, such as in silver plating where silver is deposited as follows:

$$Ag^{+1}+e^{-}\rightarrow Ag\downarrow$$

To beneficially prevent the inhibitive action of silica when present in excess amounts (over 0.5 ppm) which retards the plating process and causes voids during metal deposition, which is particularly harmful during silver plating for mirror production, certain amine compounds have been determined to retard the effects of silica, thus allowing the plating process to continue unabated.

For test purposes, both two part and three part plating solutions were prepared. These control plating solutions were carefully prepared, tested and found to have acceptable performance under silica concentration levels of less than 0.5 ppm. Next, certain of the same solutions were tested under high silica concentrations (approximately 6–7 ppm) and also at very high silica conditions (over 10 ppm). The results confirmed that certain amine compounds such as triethyleneglycol diamine, monoethanolamine and monoethanolamine combined with triethyleneglycol diamine are effective in preventing the detrimental effects of excess silica. The amines were added to the reducing agent solution in the two part plating system and in the three part plating system, the amines were added to the alkaline solution.

DETAILED DESCRIPTION OF THE PREFERRED EMBODIMENTS AND EXAMPLES OF THE INVENTION

For the test examples as set forth below, concentrates for a two part silver plating system were prepared as follows: an ammoniacal silver nitrate solution was prepared by dissolving 250 grams of silver nitrate in a small amount of deionized water. The silver nitrate solution was then added to 325 ml of ammonium hydroxide (29.5%) and the solution brought to 1 liter with sufficient deionized water. One liter of reducing agent solution was prepared by combining 198 grams of sodium hydroxide; 100 ml of ammonium hydroxide (29.5%); 140 ml sorbitol (70%); 5 grams of sodium gluconate.

EXAMPLE 1

The two part silvering system as set forth immediately above was first evaluated under ideal water quality conditions. A conductivity of greater than 1 megohm resistance and a silica content of less than 0.5 ppm were typical during plating.

Silver Nitrate Solution (1 liter)
250 grams silver nitrate
325 ml ammonium hydroxide (29.5%)

The silver nitrate was dissolved in deionized water then added to the ammonium hydroxide and brought up to 1 liter.

Reducing Agent Solution (1 liter)
198 grams sodium hydroxide
100 ml ammonium hydroxide (29.5%)
140 ml sorbitol (70%)
5 grams sodium gluconate The concentrated solution of silver nitrate was diluted 1 part to 30 of water (33 ml of concentrate diluted to a liter). The concentrated reducing agent solution containing ammonia was diluted in the same manner. Each solution was placed in a 1 liter bottle in preparation for spraying.

A thin piece of single strength glass having the dimensions, 8 inches by 11 inches by ⅛ thickness was cleaned (on one side) by hand using a water slurry of cerium oxide and a felt block. The glass was then thoroughly rinsed with deionized water.

Just prior to silvering, the glass was sensitized with a solution of stannous chloride. The solution was prepared by dilution of a conventional concentrated aqueous solution of stannous chloride and hydrochloric acid to yield a solution of approximately 0.2 gm stannous chloride per liter. The solution was left on the glass (cleaned side) for a few seconds and then rinsed completely with deionized water.

The two diluted solutions (silver nitrate and reducing agent) were then pumped onto the glass surface simultaneously through spray nozzles producing an overlapping fan pattern on the glass surface. The solutions were applied to the glass surface at a rate of 190 ml/minute. A sweeping pattern was used so that the entire glass surface was covered. A metallic film of silver was immediately deposited on the glass as a uniform, continuous, brilliant film. After approximately a few seconds, the solutions were rinsed from the glass with deionized water.

EXAMPLE 2

High (6–7 ppm) Silica Concentrations

In this example, the two part plating system concentrates as in Example 1 were used under high (excess) silica water conditions. A water solution having approximately 6–7 ppm silica was prepared by dissolving 0.537 g of sodium metasilicate, ($Na_2SiO_3]9H_2O$]) in 5 gallons of deionized water. The concentration was confirmed spectrophotometrically using the standard heteropoly blue method.

The solution concentrates were prepared in the same manner as in Example 1, however, using the silicated (6–7 ppm) water. When the solutions were sprayed onto the glass large, voided areas where no silver deposition occurred were observed. The areas that did plate developed slowly and lacked brilliance. In most cases the silver film had a hazy, blue coloration and poor adhesion to the glass was noted.

EXAMPLE 3

High (6–7ppm) Silica Concentrations

In this example a two part plating system was employed with a preferred reducing agent solution prepared having triethyleneglycol diamine (S.G.=1.036 gm/cc) as an excess silica control agent at a concentration of 2% by volume of the solution as set forth below. Plating solutions (silver nitrate and reducing agent) were prepared as usual for spraying, but once again, using the silicated water (6–7 ppm). Upon spraying on the glass surface, a uniform, brilliant silver film formed. None of the adverse effects of silica noted previously in Example 2 were observed.

Reducing Agent Solution For Example 3 (1 liter)
198 grams sodium hydroxide
100 ml ammonium hydroxide (29.5%)
140 ml sorbitol (70%)
5 grams sodium gluconate
20 ml triethyleneglycol diamine (TEGD)

EXAMPLE 4

High 6–7 ppm) Silica Concentrations

In this example with a two part system, the ammonia component of the reducing agent solution was replaced with monoethanolamine. The concentrated silver nitrate and reducing agent solutions were diluted with high silicated (6–7 ppm) water and sprayed onto a piece of sensitized glass. No voiding occurred and a brilliant, uniform silver film was produced.

Reducing Agent Solution For Example 4 (1 liter)
198 grams sodium hydroxide
100 ml monoethanolamine (MEA)
140 ml sorbitol (70%)
5 grams sodium gluconate

EXAMPLE 5

High 6–7 ppm) Silica Conditions

In this example another preferred reducing agent solution concentrate was prepared having monoethanolamine and triethyleneglycol diamine. No voiding occurred and a brilliant, uniform silver film was deposited.

Reducing Agent Solution For Example 5 (1 liter)
198 grams sodium hydroxide
66 ml monoethanolamine (MEA)
140 ml sorbitol (70%)
5 grams sodium gluconate
20 ml triethyleneglycol diamine (TEGD)

EXAMPLE 6

High 6–7 ppm) Silica Conditions

In this example, the reducing agent solution was prepared having MEA and 4,7,10-trioxa-1,13tridecanediamine (TTD). The reducing agent solution was tested and no voiding was observed. A uniform, brilliant silver film was produced.

Reducing Agent Solution For Example 6 (1 liter)
198 grams sodium hydroxide
66 ml MEA
140 ml sorbitol (70%)
5 grams sodium gluconate
60 ml TTD

EXAMPLE 7

High (16 ppm) Silica Conditions

In this example, a reducing agent solution was prepared having MEA and TEGD. Very high silica conditions were chosen and the amount of TEGD increased to accommodate the increase. No voiding was detected and a uniform, brilliant film of silver was deposited.

Reducing Agent Solution For Example 7 (1 liter)
198 grams sodium hydroxide
66 ml monoethanolamine (MEA)
140 ml sorbitol (70%)
5 grams sodium gluconate
133 ml triethyleneglycol diamine (TEGD)

In the next several examples (8–12), a three part silver plating system was employed using: (1) a silver nitrate solution, (2) a reducing agent solution, and (3) an alkaline solution.

EXAMPLE 8

Control

In this example, three discrete plating solutions were used to produce a silver film on a glass substrate under normal (0.5 ppm or less) silica concentrations. The silver nitrate solution remained the same as was for the two part examples above, however, the reducing agent solution and an alkaline solution were separate solutions. For one test, aqueous ammonia was used in the alkaline solution. In another test, monoethanolamine was used in the alkaline solution instead of ammonia. The silver solution was diluted in the same manner as in Example 1 for spraying. The reducing agent solution was diluted: 1 part to 30 of deionized water and placed into a 1 liter bottle for spraying. One part of either of the alkaline solutions was then added to the same 1 liter bottle as the reducing agent solution and the volume brought up to 1 liter with deionized water. The two solutions (silver nitrate and reducing agent/alkaline) were sprayed onto a piece of sensitized glass. In that way, the component solutions were treated as a two part system even though three separate solutions were initially prepared. In many commercial applications three solutions can be sprayed discretely onto the glass through three individual, dedicated nozzles. The approach herein however demonstrates an acceptable practice. Using either alkaline solution, upon spraying, both silver films formed were uniform and brilliant with no voids.

Solutions For Example 8

I. Alkaline Ammonia Solution (1 liter)

198 grams sodium hydroxide 100 ml ammonium hydroxide (29.5%)

II. Reducing Agent Solution (1 liter)

48 grams invert sugar 133 ml sorbitol (70%)

III. Alkaline (MEA) Solution (1 liter)

198 grams sodium hydroxide 66 ml monoethanolamine (MEA)

EXAMPLE 9

Very High (11 ppm) Silica

In this example, a three part plating system using the alkaline ammonia solution was tested under very high silica conditions. Upon spraying, very large voids were produced where no plating of silver occurred. Areas with some plating were of poor quality, lacking in brilliance.

EXAMPLE 10

High 6–7 ppm) Silica Conditions

In this example, a three part plating system was tested using the silica control solution of Example 8 but 100 ml MEA per liter and with with less excess silica than in Example 9. Upon spraying, no voiding occurred and a uniform, brilliant film was deposited.

EXAMPLE 11

Very High (11 ppm) Silica Conditions

In this example, triethyleneglycol diamine (TEGD) was added to the alkaline ammonia solution (as in Example 8) of a three part system at a concentration of 4% by weight. When the solutions were sprayed onto the glass substrate for plating no voiding occurred and a uniform silver film was produced.

Alkaline Solution For Example 11

I. Preferred Alkaline Ammonia Solution (1 Liter)

198 grams sodium hydroxide 100 ml ammonium hydroxide (29.5%)

40 ml triethyleneglycol diamine (TEGD)

EXAMPLE 12

High (11 ppm) Silica Conditions

In this example, TEGD was added to the alkaline, monoethanolamine solution at a concentration of 4% by weight and tested under high silica conditions. Upon spraying, no voiding occurred and a uniform silver film was deposited.

Alkaline Solution For Example 12

I. Alkaline (MEA) Solution (1 Liter)

198 grams sodium hydroxide 100 ml monoethanolamine (MEA)

40 ml triethyleneglycol diamine (TEGD)

Various amines are listed below which are useful in silica control when added to silver nitrate solutions, alkaline solutions or reducing agent solutions as seen in Groups I, II and III in either two or three part plating solutions.

Group I (General Formula)

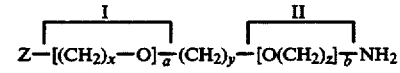

where:

$Z{=}NH_2$ or OH $X=1$–$6$;

$Y=1$–$6$;

$z=1$–$6$;

$a=1$–$6$; and $b=0$–$6$; and:

I and II may be:

with

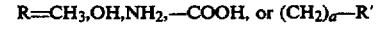

and with $R'=R$.

The preferred compound of Group I is triethyleneglycol diamine (TEGD):

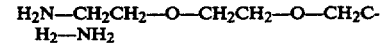

from a class of polyether amines, polyoxyalkalene amines or polyoxyethylene diamines.

Other commercial Group I amines are as follows:

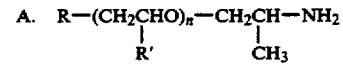

with:

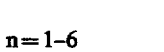

and $n=1$–$6$

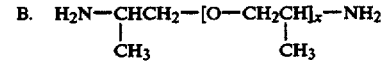

with:

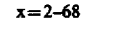

C. $H_2N-\underset{\underset{CH_3}{|}}{CH}CH_2-[O-\underset{\underset{CH_3}{|}}{CH}CH_2]_a-[O-CH_2CH_2]_b-[O-CH_2\underset{\underset{CH_3}{|}}{CH}]_c-NH_2$ Another commercially available product with very similar properties to triethyleneglycoldiamine is:

$H_2N-\underset{\underset{R}{|}}{CH}CH_2-[O-CH_2\underset{\underset{R}{|}}{CH}]_x-NH_2$ where:

A final, commercially available example of Group I is:

$H_2N-CH_2CH_2CH_2-O-CH_2CH_2-O-CH_2CH_2-O-CH_2CH_2CH_2-NH_2$

As mentioned previously, the compounds may be added to any of the plating solutions Due to their inherent alkaline nature, the preferred method is to make the additions to either the alkali-reducer and/or the silver diamine solutions. Addition to the silver solution requires lowering the pH with ammonium nitrate or similar compounds to retard reduction to metallic silver. Typically, additions are made at 2% by weight, however more or less may be added up to and including the solubility limit, depending upon the degree of silica control desired. At a 2% addition to the alkali-reducer alone, the level of silica resistance is around 6 ppm.

Group II: Other amine type compounds which has been found effective for silica control are as follows:

$H_2N-(CH_2)_n-OH$ where: n=2–8

B. $R-(CH_2)_n-\underset{\underset{NH_2}{|}}{CH}CH_2-OH$ where: n=0–5 and R=$CH_3$,$NH_2$,OH,COOH, or $CH_3-O-$

The first compound general structure comes from the amino alcohol class of amines. The second general structure also covers amino alcohols but can also include amino acids, ethers, etc. depending upon the "R" group. The main intent of the second structure is to represent an isomeric form of the first general structure with R being $CH_3$, typically. Both compound types are primary amines with monoethanolamine the principle compound. The compounds, 3-amino 1-propanol and 2-amino 1-propanol also find application. The amino alcohols of this group are typically added at a preferable concentration of 100–300+ grams/gallon of the concentrated solutions mentioned above although a broader range of concentrations up to and including the solubility limit of the particular amine selected, is possible. Such amino compounds could also be used in the silver nitrate solution. Solutions containing ammonia (ammonia hydroxide) alone do not retard or control the adverse effects of silica.

The final group of useful amine compounds comprise an assortment of structures having some similarities to Groups I and II.

Group III—Other amines found effective for silica control are:

A. 1A2A-4,6-dioxabicyclo(3.3.0) octane:

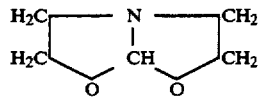

B. dimorpholinodiethylether:

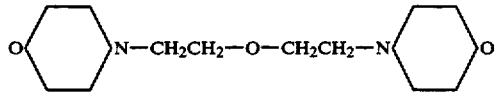

C. 2-(2-aminoethylamino) ethanol:

$H_2N-CH_2CH_2-NH-CH_2CH_2-OH$

D. aminoethoxyethylmorpholine:

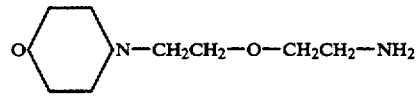

E. aminopropylmorpholine:

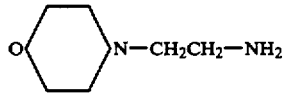

F. hydroxyethoxyethylmorpholine:

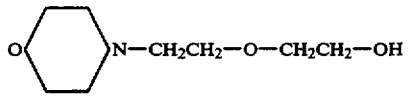

G. 1,4-dioxa-8-azaspiro-4,5-decane:

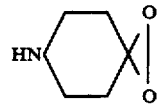

The illustrations and examples provided herein are for explanatory purposes and are not intended to limit the scope of the appended claims.

I claim:

1. A method to control the adverse effects of excess silica present during metal deposition comprising the steps of:

(a) adding an effective amount of a chemical compound to control the adverse effects of excess silica selected from the group consisting of:

$$Z-\overbrace{[(CH_2)_x-O]_a}^{I}(CH_2)_y-\overbrace{[O(CH_2)_z]_b}^{II}NH_2$$

where:

Z=$NH_2$ or OH

X=1–6;

Y=1–6;

z=1–6;

a=1–6; and b=0–6;

and:

Any I and II may be:

$$[(\underset{\underset{R}{|}}{CH}CH_2)_x-O]_a \quad \text{or} \quad [(CH_2\underset{\underset{R}{|}}{CH})_x-O]_a$$

with $$R=CH_3,OH,NH_2,-COOH, \text{ or } (CH_2)_a-R'$$

and with $R'=R$ to a metal deposition solution, and (b) controlling the excess silica with said chemical compound during metal deposition.

2. The method of claim 1 wherein the compound selected comprises a polyoxyethylene diamine.

3. The method of claim 1 wherein the compound selected comprises triethyleneglycol diamine.

4. A method to control the adverse effects of excess silica present during metal deposition comprising the steps of:

(a) adding an effective amount of a chemical compound to control the adverse effects of excess silica selected from the group consisting of:

$$R-(CH_2\underset{\underset{R'}{|}}{CH}O)_n-CH_2\underset{\underset{CH_3}{|}}{CH}-NH_2$$

with:

$R$ & $R'=H$ or $CH_3$ where:

$n=1-6$ to a metal deposition solution, and (b) controlling the excess silica with said chemical compound during metal deposition.

5. A method to control the adverse effects of silica present in metal deposition solutions comprising the steps of:

(a) adding an effective amount of a chemical compound to control the adverse effects of excess silica selected from the group consisting of:

$$H_2N-\underset{\underset{CH_3}{|}}{CH}CH_2-[O-CH_2\underset{\underset{CH_3}{|}}{CH}]_x-NH_2$$

to a metal deposition solution, and (b) controlling the excess silica with said chemical compound during metal deposition.

6. A method to control the adverse effects of excess silica present during metal deposition comprising the steps of:

(a) adding an effective amount of a chemical compound to control the adverse effects of excess silica selected from the group consisting of:

$$H_2N-\underset{\underset{CH_3}{|}}{CH}CH_2-[O-\underset{\underset{CH_3}{|}}{CH}CH_2]_a-[O-CH_2CH_2]_b-[O-CH_2\underset{\underset{CH_3}{|}}{CH}]_c-NH_2$$

to a metal deposition solution, and (b) controlling the excess silica with said chemical compound during metal deposition.

7. The method to control the adverse effects of excess silica present during metal deposition as set forth in claim 1 comprising adding an effective amount of the chemical compound to control the adverse effects of excess silica:

$$H_2N-CH_2CH_2-O-CH_2CH_2-O-CH_2CH_2-NH_2.$$

8. A method to control the adverse effects of excess silica present during metal deposition comprising the steps of:

(a) adding an effective amount of a chemical compound to control the adverse effects of excess silica selected from the group consisting of:

$$H_2N-(CH_2)_n-OH$$

with:

$n=2-8$ to a metal deposition solution, and (b) controlling the excess silica with said chemical compound during metal deposition.

9. A method to control the adverse effects of excess silica present during metal deposition comprising the steps of:

(a) adding an effective amount of a chemical compound to control the adverse effects of excess silica selected from the group consisting of:

$$R-(CH_2)_n-\underset{\underset{NH_2}{|}}{CH}CH_2-OH$$

with:

$n=0-5$ and $$R=CH_3,NH_2,0H,COOH, \text{ or } CH_3-O-$$

to a metal deposition solution, and (b) controlling the excess silica with said chemical compound during metal deposition.

10. A method to control the adverse effects of excess silica present during metal deposition solutions comprising the steps of:

(a) adding an effective amount of the chemical compound to control the adverse effects of excess silica:

$$H_2N-\underset{\underset{R}{|}}{CH}CH_2-[O-CH_2\underset{\underset{R}{|}}{CH}]_x-NH_2$$

with:

$X=2-3$, and $$R=CH_3$$

to a metal deposition solution, and (b) controlling the adverse effects of excess silica with said chemical compound during metal deposition.

11. The method of claim 9 wherein said compound comprises 2-amino-1-ethanol.

12. The method of claim 8 wherein said compound comprises 3-amino 1-propanol.

13. The method of claim 9 wherein said compound comprises 2-amino 1-propanol.

14. The method of controlling the adverse effects of excess silica in a metal deposition solution comprising adding an effective amount of the compound 1-A2A-4,6-dioxabicyclo(3.3.0) octane:

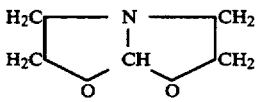

to the metal deposition solution to control the adverse effects of said excess silica.

15. The method of controlling the adverse effects of excess silica in metal deposition solution comprising adding an effective amount of the compound dimorpholinodiethylether:

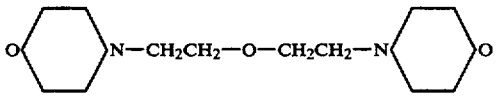

to the metal deposition solution to control the adverse effects of said excess silica.

16. The method of controlling the adverse effects of excess silica in a metal deposition solution comprising adding an effective amount of the compound 2-(2-aminoetheylamino) ethanol:

$H_2N—CH_2CH_2—NH—CH_2CH_2—OH$ to the metal deposition solution to control the adverse effects of said excess silica.

17. The method of controlling the adverse effects of excess silica in a metal deposition solution comprising adding an effective amount of the compound aminoethoxyethylmorpholine:

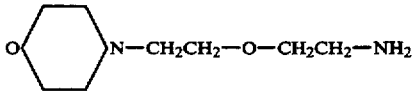

to the metal deposition solution to control the adverse effects of said excess silica.

18. The method of controlling the adverse effects of excess silica in a metal deposition solution comprising adding an effective amount of the compound aminopropylmorpholine:

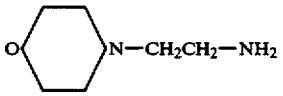

to the metal deposition solution to control the adverse effects of said excess silica.

19. The method of controlling the adverse effects of excess silica in a metal deposition solution comprising adding an effective amount of the compound hydroxyethoxyethylmorpholine:

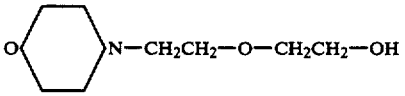

to the metal deposition solution to control the adverse effects of said excess silica.

20. The method of controlling the adverse effects of excess silica in a metal deposition solution comprising adding an effective amount of the compound 1,4-dioxa-8-azaspiro-4,5-decane:

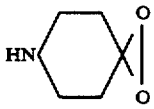

to the metal deposition solution to control the adverse effects of said excess silica.

21. The method of claim 1 wherein controlling the excess silica comprises controlling the silica doting metal plating.

22. The method of claim 1 wherein the step controlling the excess silica comprises controlling the excess silica during silver plating.

23. The method of claim 1 wherein controlling the excess silica comprises controlling the excess silica during silver plating on glass.

24. An alkaline solution for use in electroless metal deposition in the presence of silica comprising: an effective amount of an organic amine to control the adverse effects of excess silica.

25. The alkaline solution of claim 24 wherein said organic amine comprises triethyleneglycol diamine.

26. The alkaline solution of claim 24 wherein said organic amine comprises 4,7,10-trioxa-1,3,tridecane diamine.

* * * * *